US006817604B2

(12) United States Patent
Ohlmann et al.

(10) Patent No.: US 6,817,604 B2
(45) Date of Patent: Nov. 16, 2004

(54) DEVICE FOR ADJUSTING CONVEYORS FOR FLAT PRODUCTS IN ROTARY PRESSES

(75) Inventors: Fabien Ohlmann, Avrechy (FR); Olivier Sonntag, Rantigny (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 26 days.

(21) Appl. No.: 09/961,017

(22) Filed: Sep. 21, 2001

(65) Prior Publication Data

US 2002/0043450 A1 Apr. 18, 2002

(30) Foreign Application Priority Data

Sep. 21, 2000 (DE) ..... 100 46 812

(51) Int. Cl.[7] ..... B41F 13/58
(52) U.S. Cl. ..... 270/5.02; 198/817
(58) Field of Search ..... 198/458, 817; 83/155, 401; 270/5.02

(56) References Cited

U.S. PATENT DOCUMENTS

| | | | | |
|---|---|---|---|---|
| 1,252,681 A | | 1/1918 | Freiss | |
| 3,860,232 A | * | 1/1975 | Martin | 198/458 |
| 4,413,723 A | | 11/1983 | Stobb | 198/415 |
| 4,508,210 A | | 4/1985 | Ramcke et al. | 198/627 |
| 5,855,368 A | | 1/1999 | Middelberg et al. | 271/272 |
| 5,871,434 A | | 2/1999 | Eckelt et al. | 493/461 |
| 6,032,788 A | * | 3/2000 | Smithers et al. | 198/817 |

FOREIGN PATENT DOCUMENTS

| | | |
|---|---|---|
| DE | 40612 | 8/1965 |
| DE | 2438607 | 2/1976 |
| DE | 3242887 | 6/1983 |
| DE | 3303331 | 8/1983 |
| DE | 19545349 | 6/1997 |
| DE | 19782204 | 12/1999 |

* cited by examiner

*Primary Examiner*—Joseph E. Valenza
(74) *Attorney, Agent, or Firm*—Davidson, Davidson & Kappel, LLC

(57) ABSTRACT

A device for adjusting conveyors for printing presses that process flat products or further processing units (40) arranged downstream therefrom, in which are received belt movers (1) containing a plurality of individual belts (5) for transporting the flat products, the belt movers including guide rollers (6) and setting rollers (7), which have a drive (2), and use tensioning devices (3) which keep constant the tension in the individual belts (5) of the belt mover (1). Accommodated in the further processing unit (40), whether it be a folder with pins or a folder that works without pins, arranged downstream from the rotary press, are shafts (16, 28, 34) having elements (25, 31, 39), which are arranged in a stationary mount and guide the individual belts (5). Supported on these so as to enable sliding in the axial direction, symmetrically with respect to the machine center (13), are movable elements (20, 27, 36), which guide, drive, and/or prestress the individual belts (5).

20 Claims, 5 Drawing Sheets

DEVICE FOR ADJUSTING CONVEYORS FOR FLAT PRODUCTS IN ROTARY PRESSES

BACKGROUND OF THE INVENTION

The present invention is directed to a device for laterally adjusting conveyors, i.e transport devices, for flat products in rotary presses, such as in belt movers for transporting products in folders configured subsequent to web-processing rotary presses.

Conveyor belt movers in folding apparatuses are known from JP HEI 7-8364. It provides for belt movers in the folder, which is disposed downstream from a rotary press, to be used at the second longitudinal folding device for flat products. Printed products to be provided with a second longitudinal fold are inserted by a vertically up-and-down movable folding blade into the fold nip between two folding rollers underneath a feeder table. To position the products to be folded above the folding roller nip, the products are gripped on both sides and carried up to positioning stops, prior to the back parts of the products to be folded being pushed into the nip of the folding rollers.

EP Patent 0 553 739 B 1 describes a device for adjusting sheet guide elements in rotary presses. It discusses a device for adjusting sheet hold-down devices, which are movable by a drive transversely to the sheet travel path and include carriers and pressing elements. The hold-down devices are mounted on a rotatable shaft and engage with oppositely directed, helical slits on the shaft. A longitudinally slit, frame-fixed, hollow member is provided, upon which rings encircle its periphery in a sliding-type arrangement. These rings each carry a sheet hold-down device, and, together with the hollow member, they provide a locking against rotation. The rings each have a guide pin directed toward the inside of the hollow member. Mounted inside of the hollow member is a shaft that is rotatably supported at its ends. On its first half length, the shaft has at least two helical slits of different pitches, which are mirror-inverted with respect to at least two helical slits on a second half length of the shaft. Assigned to each slit is a ring, which has a ring-fixed guide pin that engages in the slit with force- and form-locking, the pitch of the slits towards the ends of the rotatable shafts decreasing.

To ensure a damage-free product transfer when it comes to belt movers used for transporting flat products in folders of web-processing rotary presses, it has been established that a precise adaptation of the distance between the transport belts conveying the products is of great importance.

SUMMARY OF THE INVENTION

In consideration of the approaches known from the related art, the object of the present invention is to devise a method for adjusting product-delivery devices in press folders, which will enable the position of the product-delivery device to be adapted to the format or size of the folded product.

The present invention provides a device for adjusting conveyors for printing presses that process flat products or for further processing units (40) arranged downstream therefrom, in which are accommodated belt movers (1) containing a plurality of individual belts (5) for transporting the flat products. The belt movers are guided via guide rollers (6) and setting rollers (7), and driven via a drive (2), and the tension in the individual belts (5) is kept constant via tensioning devices (3). Accommodated in the further processing unit (40) are shafts (16, 28, 34) having stationary elements (25, 31, 39) which guide the individual belts (5) and on which are supported, symmetrically with respect to the machine center (13), movable receiving elements (20, 27, 36), which guide, drive, and retain under constant prestressing, the individual belts (5).

The advantages associated with the approach of the present invention can be seen, above all, in that all of the elements that convey, prestress, as well as drive the individual belts of a belt mover, are now simultaneously adjusted in the lateral direction. By varying the duration of the driving of the drive effecting the lateral adjustment motion, different travel paths may be implemented, so that the belt mover width may be adapted to all current folded product formats to be processed, at a second longitudinal folding device within a folder arranged downstream from a rotary press. Since it is ensured that all the elements supporting the individual belts of a belt mover are driven around the same paths with respect to the machine center, a strictly parallel positioning of all individual belts of a belt mover in relation to one another is ensured. This substantially improves the folding accuracy, since there are now no longer forces acting in a direction perpendicular to the product delivery direction on the products to be folded. A substantially greater product quality is able to be achieved due to the precision feeding of the printing sheets to be folded and their delay at stops, before there is a downward movement of a folding blade within the second longitudinal folding device.

The individual belts of a belt mover of elements that, as the case may be, are guiding, driving, and retained under initial stress, may advantageously be indirectly or directly driven on shafts. If sufficient installation space is available within the folder, i.e., in the second longitudinal folding device, then the driving elements may be indirectly adjusted at their shafts, for example using adjusting forks, while, in accordance with one alternative specific embodiment, guide rollers for the individual belts of a belt mover may be driven directly at the shafts accommodating them.

Besides accommodating the elements that guide, drive, or prestress the individual belts of a belt mover, in an individual type of construction, pairs or groups of elements that guide, drive, or hold under constant prestressing the individual belts are also able to be accommodated at the receiving elements that are able to be driven laterally with respect to the product delivery device. They may be supported so as to be relatively movable on cylindrical or slide-type receiving bodies, the cylindrical or slide-type receiving bodies being able to be driven indirectly or directly at the shafts supporting them.

In one embodiment of the idea underlying the present invention, for purposes of lateral adjustment, the cylindrical or slide-type receiving elements may be provided with spindle drives having contrary-sense threaded sections. Using the pitch of the contrary-sense threaded sections, exact travel paths of the individual receiving elements, whether they be configured in a slide-type or cylindrical shape, are able to be achieved with respect to the machine center.

The slide-type receiving elements, at which the cylinders that retain the individual belts of the belt movers under constant prestressing may be accommodated, may be individually penetrated by the threaded spindle sections of different pitches. The adjusting forks surrounding the cylindrical elements may also be rotatably accommodated at the spindle-shaped drive elements indirectly driving the cylindrical receiving elements. In another variant of an embodiment of the idea underlying the present invention, the receiving elements guiding the individual belts are themselves able to be directly driven on contrary-sense threaded sections of the adjusting shaft. To this end, the adjusting shaft may be provided, symmetrically with respect to the machine center, with stationary elements guiding the individual belts, and, on both sides of their mid-section, have conically tapered sections, which, for their part, may be provided with threaded sections of different pitches.

In this variant of an embodiment, the receiving elements used for guiding the individual belts are secured by an anti-rotation element in the further processing unit, at its side walls, in order to prevent an unwanted change in the lateral position of each of the individual belts of the conveyor belt movers with respect to one another.

The elements situated in relation to the stationary components and used for guiding, driving, and constant prestressing, may be driven laterally, individually, or also, in pairs.

The device proposed by the present invention for adjusting delivery elements for transporting flat products may be used for sheet-processing rotary presses, whether it be for conventional offset presses or also for digitally operating sheet-fed presses. It is particularly significant for folders, in which, in web-processing rotary presses, folded products, printed on one side or multiple sides, are produced, and are then provided with a second longitudinal fold in a second longitudinal folding device. The design accuracy of the device plays a decisive role in the product quality. Relative movements are not allowed to occur in the belt mover gripping the product on both sides, before the product is longitudinally folded, by pushing the folding spine into the cooperating jackets of a folding roller pair.

BRIEF DESCRIPTION OF THE DRAWINGS

The present invention is explained with reference to the following, in which.

DETAILED DESCRIPTION

Figure 1:
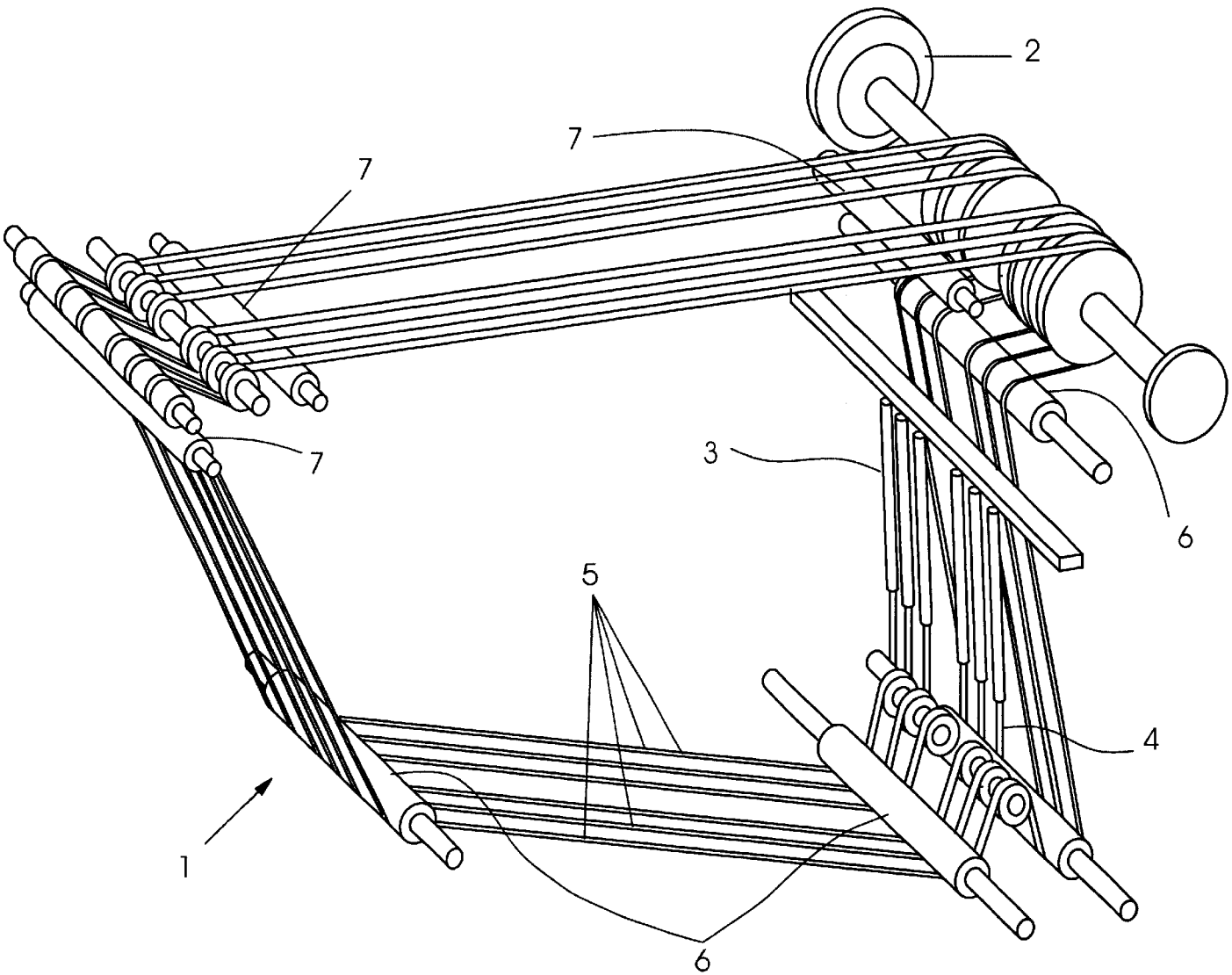
FIG. 1 shows the general design of a conveyor belt mover for transporting flat products.

The illustration in accordance with FIG. 1 shows the general design of a conveyor belt mover for transporting flat products, such as products to be folded, printed on one side or multiple sides.

Individual belts 5 of belt mover 1 from the illustration of FIG. 1 are driven via a belt puller denoted by reference numeral 2. Belt mover drive 2 may be a separate drive on a rotary press or a folder; but, it may also be coupled into the geared drive of these machines. Individual belts 5 of belt mover 1 may be prestressed via a tensioning cylinder that is retained under individually adjustable prestressing and rotationally accommodated on a shared tensioning-cylinder bearing arrangement, enabling a uniform prestressing level to be adjusted at all individual belts 5 of a belt mover 1 and maintained during operation of belt mover 1. To maintain a strictly parallel guidance of individual belts 5 with respect to one another and with respect to machine center 13 (compare FIG. 2), individual belts 5 driven by belt mover drive 2 are run over a plurality of guide rollers 6 and setting rollers 7.

Guide rollers 6 ensure that the belts follow the individual circulating paths around the depicted roller configuration; setting rollers 7 may be used to deflect the individual belts and, to a certain extent, prestress the same. The lateral cross-pieces of the individual roller segments accommodated at guide rollers 6 prevent individual belts 5 of belt mover 1 from running out of the direction of rotation intended for them.

Figure 2:
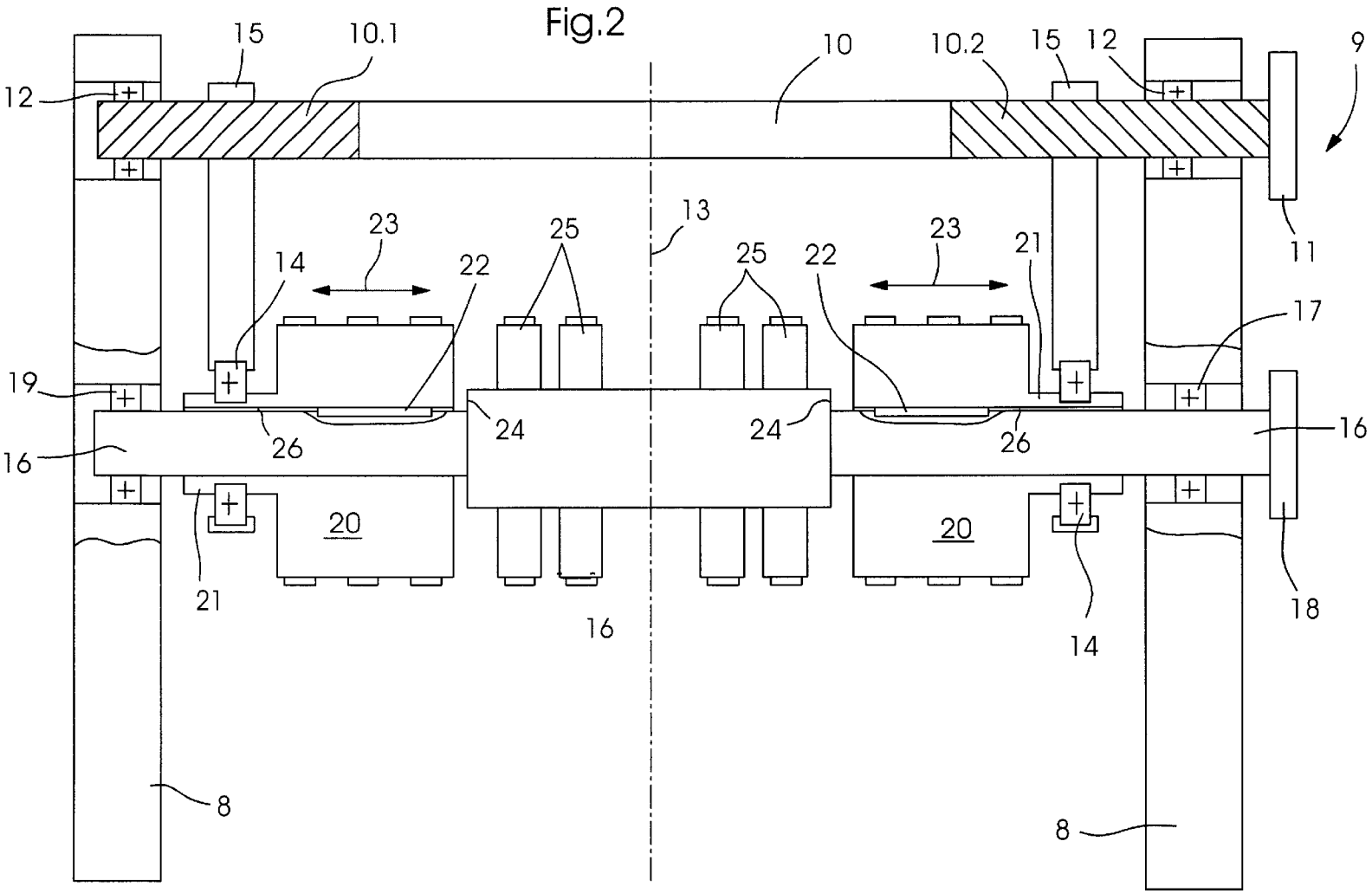
FIG. 2 shows an adjusting device, mounted in the side walls, for the components driving the individual belts of a belt mover.

FIG. 2 illustrates in greater detail an adjusting device mounted in the side walls of a folder, for example, for the individual belts of a further processing device, such as a folder, for example.

Formed on a spindle 10 supported in side walls 8 of a further processing unit are threaded sections 10.1 and 10.2, respectively, which are oppositely directed, but provided with the same thread pitch. Spindle 10 is rotatably supported via spindle bearing 12 in side walls 8 of further processing unit 40 and is driven via a spindle drive 11, not shown in greater detail. Spindle drive 11 may be constituted as an integration of drive gear of spindle 10 in the geared drive of the further processing unit in question; however, a separate drive may also be provided for spindle 10.

In accordance with the configuration of FIG. 2, adjusting forks 15 are accommodated on the spindle sections 10.1 and 10.2, respectively, configured symmetrically with respect to machine center 13. Depending on the controlling of the drive of spindle 10, a variably long travel path may be superposed in the direction of double arrow 23.

Since adjusting forks 15 encircle receiving elements 20, the travel movement of adjusting forks 15 in the direction of double arrow 23 directly entrains a travel movement of cylindrical elements 20 on shaft 16. Cylindrical receiving elements 20 are able to be driven in the direction of double arrow 23 via an adjusting spring connection 22, 26 at journals configured on shaft 16, on both sides with respect to machine center 13. Rolling-contact bearings 14 are provided between adjusting forks 15 and cylindrically configured receiving elements 20 in accordance with FIG. 2, to continually ensure the rotation of the axially movable receiving elements 20 with respect to adjusting forks 15.

Situated between cylindrical receiving elements 20 accommodated symmetrically with respect to machine center 13 at shaft 16 is a section of shaft 16, which has a number of disk-shaped elements accommodated in stationary fashion. Disk-shaped elements 25 accommodated in stationary fashion are likewise symmetrically disposed with respect to machine center 13, and likewise constitute a driving component of individual belts 5 of belt mover 1, as they are driven by a shaft drive 18, not shown in greater detail.

Three individual belts 5 run, by groups, around receiving elements 20, a higher or lower number also being possible, of course, depending on the configuration of the surface area of cylindrical receiving elements 20.

In place of adjusting spring connection 22, 26 shown here, the sliding region of shaft 16, on which receiving elements 20 are axially displaceable in the direction of double arrow 23, may also be designed to have a multisplined profile or the like, to ensure a precise axial guidance of cylindrical receiving elements 20 driving individual belts 5 of belt mover 5, as well as a reliable transmission of the drive torque of shaft drive 18.

Figure 3:
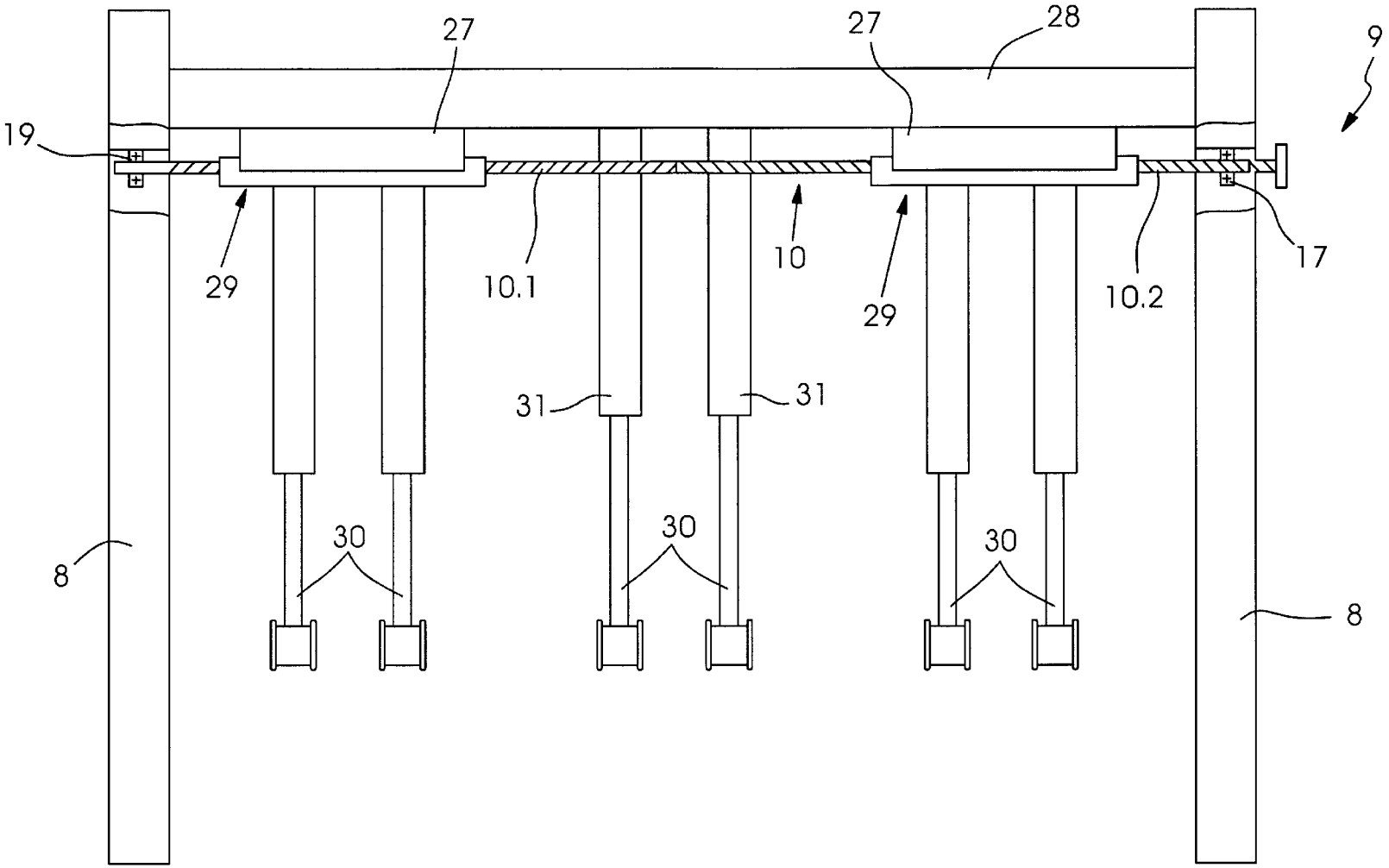
FIG. 3 shows an adjusting cylinder configuration, in groups, for individual belts of a belt mover, whose outer adjusting cylinders are displaceable in pairs.

A group-type adjusting-cylinder configuration for belt movers proceeds in greater detail from the representation in accordance with FIG. 3. Its outer adjusting cylinders are displaceable, in pairs, on slide-type elements.

Slide or carriage-type support 28 depicted in FIG. 3 is arranged in a stationary mount in side walls 8 of a further processing unit. Likewise received in stationary fashion on slide support 28, symmetrically to machine center 13 in accordance with FIG. 2, are adjusting cylinders 31, to whose extension-stroke piston rods 30, belt rollers are attached which prestress individual belts 5 of belt mover 1. Received in parallel to slide support 28, in side walls 8 in rolling-contact bearings 17, 19, is a spindle-shaped drive element 10. Analogously to the specific variant shown in FIG. 2, spindle-shaped drive element 10 includes two threaded sections 10.1 and 10.2, each configured in the same pitch, but in a contrary sense to one another. Threaded sections 10.1 and 10.2, respectively, of spindle drive 10 extend right through slide-type elements 27, on which are received, in turn, tensioning cylinders that prestress individual belts 5 of belt mover 1. Depending on how the driving of spindle-shaped drive element 10 via the drive provided on drive side 9 is conceived, whether it be an individual drive or a drive integrated in the geared drive of the further processing unit, various lateral travel paths may be superposed on slide-type elements 27 and, thus, on adjusting cylinders accommodated thereon.

Figure 4:
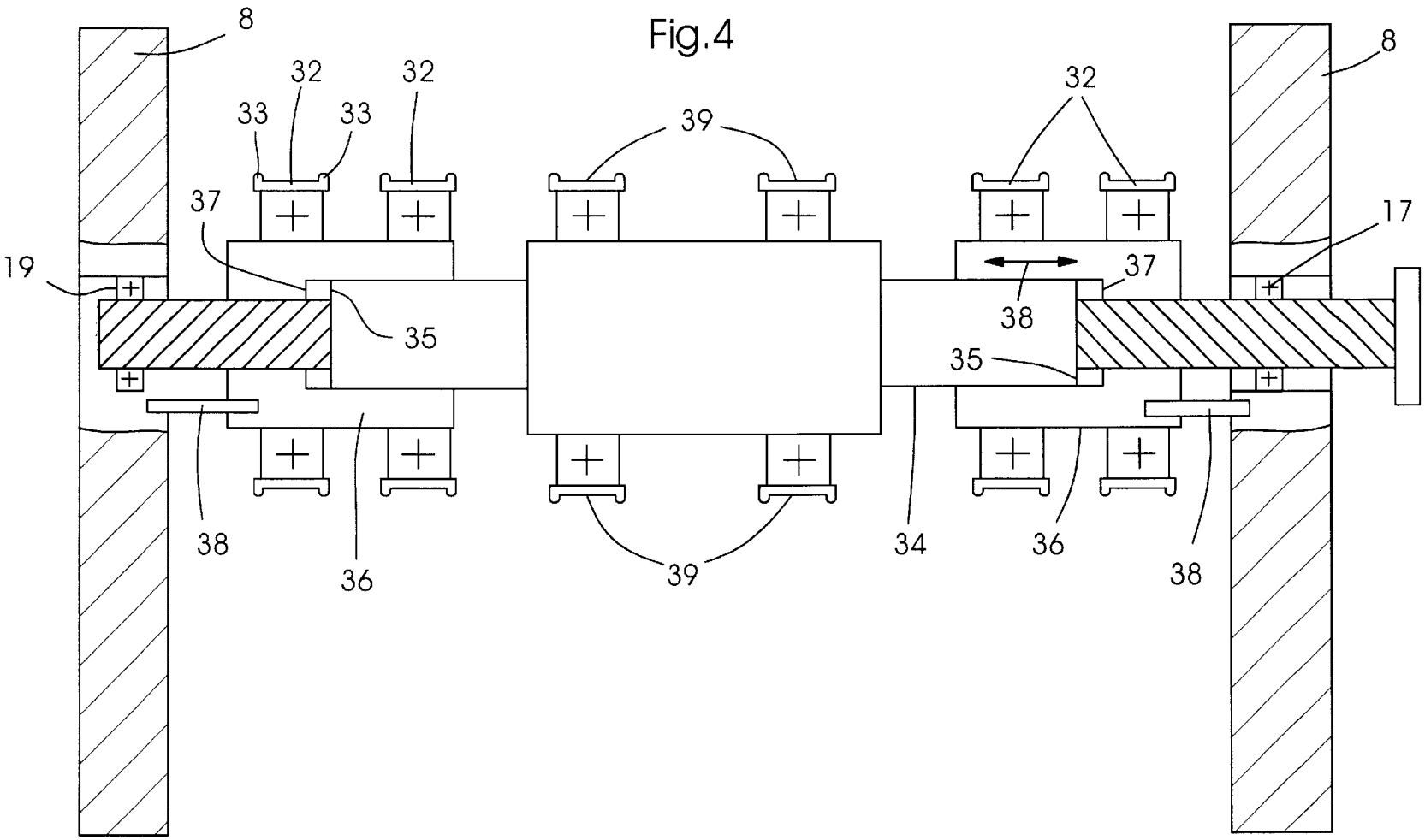
FIG. 4 shows movable belt-guide rollers, of which outer guide rollers are adjustable relatively to inner guide rollers.

The representation of FIG. 4 shows adjustable belt guide rollers, from where outer guiding disks are able to be driven in relation to inner guiding disks.

The specific variant of FIG. 4 shows a shaft 34 rotationally accommodated in side walls 8, in rolling-contact bearings 17 and 19, respectively. Shaft 34 has a mid-section, on whose peripheral surface, two mutually spaced-apart, stationary guide rings are accommodated in the exemplary embodiment according to FIG. 4. The guide rings, whether it be fixed guide rings 38 or movable guide rings 32, each include a contact surface for individual belts 5 of belt mover 1, as well as crosspieces 33, which enclose the contact surfaces in the circumferential direction and prevent individual belts 5 of belt mover 1 from running out of their strictly parallel circulation direction.

Adjusting shaft 34 of FIG. 4 is provided on both sides with threaded sections 10.1 and 10.2, respectively, on which outer carrier segments, denoted by reference numeral 36, are received. Both guide rings 39, accommodated in stationary fashion with respect to axial movability relative to adjusting shaft 34, as well as guide rings 32, which are accommodated on outer carrier segments 36 and are movable in pairs or individually in the axial direction, are rotationally accommodated in the circumferential direction on shaft 34 and on outer carrier segments 36, respectively. By rotating adjusting shaft 34, which can be undertaken by introducing a rotary motion using a gear, carrier segments 36 are able to be rotated in the axial direction on their journals provided with contrary-sense threaded sections. For this, the two outer carrier segments 36 are each provided with an anti-rotation element 38, shown here only schematically. Accommodated on adjusting shaft 34 are limit stops denoted by reference numeral 35. They define a position of guide rings 32, in which individual belts 5 of belt mover 1 may be driven together at a minimal width with respect to the distance between side walls 8. This limit stop 35 limits the adjusting path identified by reference numeral 38 of axially displaceable guide rings 32, toward machine center 13. A similar stop means may be provided on the threaded sections of adjusting shaft 34 or also on anti-rotation elements 38.

If the drive elements illustrated in accordance with FIGS. 2, 3 and 4, for individual belts 5 of a belt mover, i.e., and/or the tensioning elements that induce a constant prestressing of individual belts 5, as well as the shafts and/or spindles driving the axial and parallel guidance of individual belts 5, are driven synchronously, then individual belts 5 of belt movers 1 may be simultaneously driven apart and/or together, within a second longitudinal folding device of a conventional folder or of a folder that works without pins, with respect to machine center 13 of these machines. The lateral displacement that takes place while the mutual parallelism of individual belts 5 is retained, ensures that the products to be folded, which are printed on one or both sides and fed to a second longitudinal folding device, are properly supported, depending on their size, that they meet limit stops, and that they are positioned at the limit stops with precise right-angled alignment with respect to the folding blade pushing them into the folding roller nip.

Figure 5:
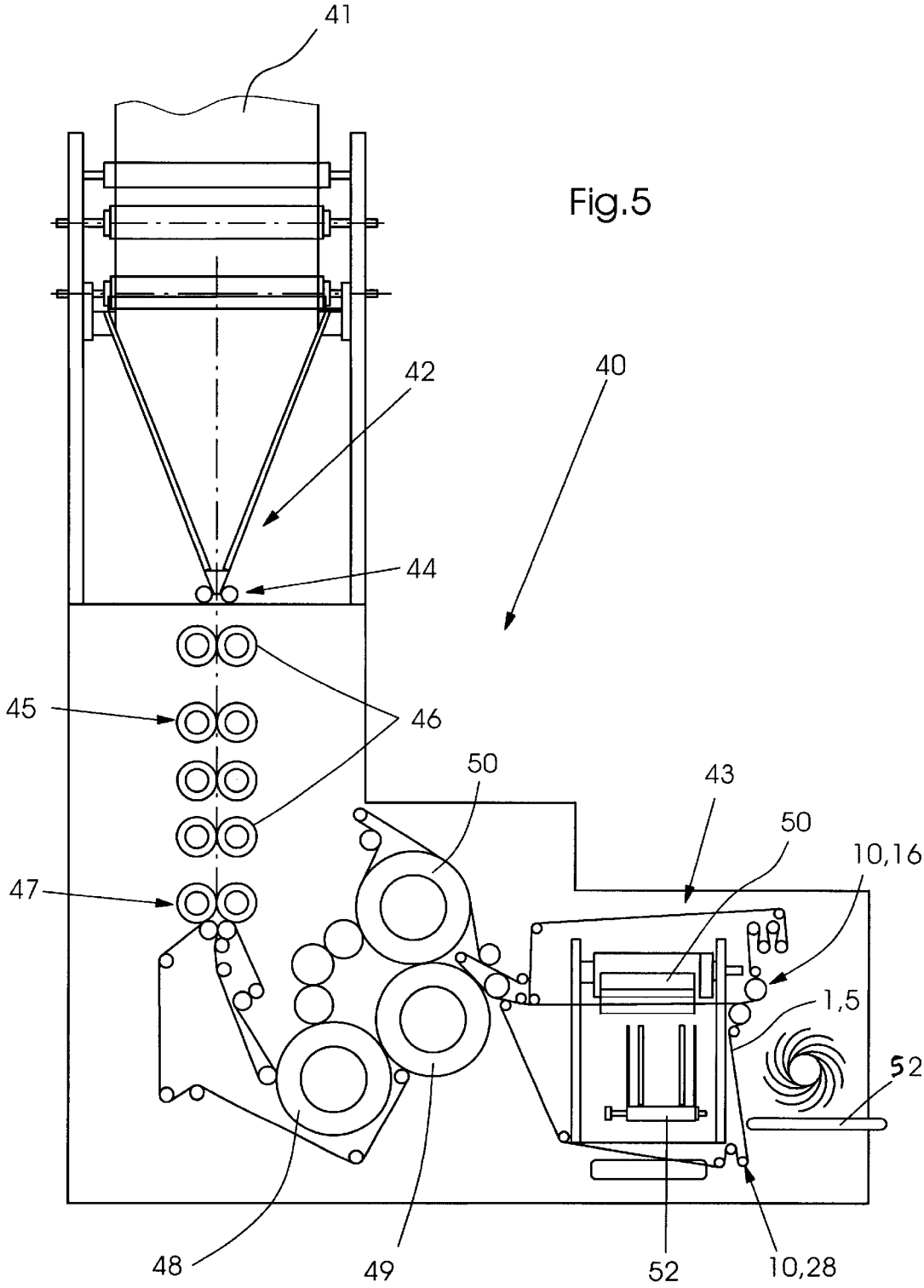
FIG. 5 shows a folder having a downstream, second longitudinal folding module and product delivery.

FIG. 5 shows a folder having a downstream, second longitudinal folding module and product delivery units provided thereon, offset by 90° from one another.

Reference numeral 41 denotes the material web running into a first longitudinal folder 42 above a cylinder part of a folder 40. The single-layer or multi-layer material web 41, which is printed on one side or multiple sides, leaves first longitudinal folding device 42, provided with a first longitudinal fold, below former rollers 44, before it runs into the cylinder part of a folder 40. After passing through a perforating roller pair accommodated between two draw (pull) roller pairs 46, individual printed products are cut off from the continuous material web by cutting cylinder pair 47. They run, carried by a belt mover and gripped on both sides, onto the peripheral surface of a transfer cylinder 48. From this cylinder, the individual products to be folded, transported one behind the other, pass over to the peripheral surface of a folding cylinder 49. Assigned thereto is an optionally loadable double-parallel/delta folding cylinder, on which, if indicated, a double-parallel fold and/or a delta fold may be completed on the individual product to be folded.

Assigned to folding cylinder 49 is a second longitudinal folding unit 43, which essentially includes a strictly vertically up-and-down movable folding blade 50. It pushes the transversely (crosswise) folded products, whether it be simply folded, double-parallel folded, or delta-folded products, into a nip formed by the surface areas of two oppositely rotating folding rollers. Once the folding spine is formed, the printed products, thus provided with a second longitudinal fold, arrive in delivery paddle wheels on a delivery belt 62 or, as the case may be, on a further delivery belt. In accordance with the proposed invention, slide-type support 28 may be accommodated at the location of second longitudinal folding module 43 characterized in FIG. 5, it being possible in accordance with the representation of FIG. 2, for shaft 16, as well as drive spindle 10 to be accommodated in the position denoted by reference symbols 10, 16. In the illustration of FIG. 5, belt mover 1, which includes a number of individual belts 5, encircles vertically moving folding blade 50, as well as the underlying paddle wheel and product delivery unit 52 (shown also in side view) assigned thereto.

The present invention may be applied quite advantageously to sheet-processing machines, such as sheet-fed rotary presses, open-sheet delivery units, and the like. In addition, the use on folders is provided, whether it be conventional folders that grip the products using pins, or whether it be folders that work without pins, which can be configured downstream from web-processing rotary presses, such as newspaper rotary presses or commercial web presses.

Reference Symbol List
1 belt mover
2 belt mover drive
3 tensioning cylinder
4 tensioning-cylinder bearing arrangement
5 individual belt
6 guide roller
7 setting roller
8 side wall
9 drive side
10 drive spindle
10.1 first threaded section
10.2 second threaded section
11 spindle drive
12 spindle bearing
13 center line
14 bearing
15 adjusting fork
16 shaft
17 rolling-contact bearing
18 shaft drive
19 rolling-contact bearing
20 adjustable receiving element
21 neck
22 adjusting spring
23 sliding direction
24 shaft collar
25 stationary disks
26 slit
27 slide carriage
28 slide support
29 adjusting-cylinder bearing arrangement
30 piston rod
31 stationary cylinder
32 guide rings
33 crosspiece
34 adjusting shaft
35 limit-stop surface
36 outer bearing segment
37 limit-stop guide slit
38 displacement path
39 stationary guide ring
40 folder
41 material web
42 first longitudinal folding device
43 second longitudinal folding device
44 former rollers
45 perforating rollers
46 draw roller pair
47 cutting cylinder pair
48 transfer cylinder
49 folding cylinder
50 double-parallel delta folding cylinder
51 folding blade
52 product delivery unit

What is claimed is:

1. A device for adjusting conveyors for flat products, comprising:

a plurality of individual belts for transporting the flat products;

at least one shaft, the at least one shaft having at least one stationary element guiding at least one first belt of the individual belts; and movable receiving elements supported on the at least one shaft, the movable receiving elements being symmetric with respect to a machine center, the movable receiving elements guiding, driving, and retaining under constant prestressing at least second and third belts of the individual belts.

2. The device as recited in claim 1 wherein the receiving elements are driven on the shafts.

3. The device as recited in claim 1 wherein the receiving elements are supported on cylindrical or slide-type receiving members.

4. The device as recited in claim 3 wherein, to laterally adjust acting drives, the cylindrical or slide-type receiving elements are provided as threaded spindles having contrary-sense threaded sections.

5. The device as recited in claim 4 wherein the threaded spindle extends through the receiving elements.

6. The device as recited in claim 4 further comprising indirectly driving spindle adjusting forks connected to the receiving elements.

7. The device as recited in claim 4 wherein the receiving elements guiding the individual belts are capable of being directly driven on the contrary-sense threaded sections of the adjusting shaft.

8. The device as recited in claim 7 wherein the receiving elements used for guiding the individual belts are supported so as to be locked against rotation.

9. The device as recited in claim 1 wherein outer individual belts of the plurality of belts are movable, individually or in pairs, in the lateral direction.

10. A sheet-processing rotary press for flat products comprising:

a sheet processing device for processing flat products, a plurality of individual belts to transport the flat products, at least one shaft having at least one stationary element guiding at least a first of the individual belts; and movable receiving elements supported on the at least one shaft symmetric with respect to a machine center, the movable receiving elements guiding, driving, and retaining under constant prestressing at least second and third of the individual belts.

11. A folder for flat products comprising:

a folding device for processing flat products, a plurality of individual belts for transporting the flat products, at least one shaft having at least one stationary element guiding at least a first of the individual belts; and movable receiving elements supported, symmetrically with respect to a machine center, on the at least one shaft, the movable receiving elements guiding, driving, and retaining under constant prestressing, at least second and third of the individual belts.

12. A pinless folder for flat products comprising:

a folding device for processing flat products, the folding device being a pinless folding device;

a plurality of individual belts for transporting the flat products;

at least one shaft having at least one stationary element guiding at least a first of the individual belts; and movable receiving elements supported, symmetrically with respect to a machine center, on the at least one shaft, the movable receiving elements guiding, driving, and retaining under constant prestressing, at least second and third of the individual belts.

13. A web-processing rotary press comprising:

a processing unit for processing a web into flat products;

a plurality of individual belts for transporting the flat products;

at least one shaft accommodated in the processing unit having at least one stationary element guiding the individual belts; and movable receiving elements supported, symmetrically with respect to a machine center, on the at least one shaft, the movable receiving elements guiding, driving, and retaining under constant prestressing the individual belts.

14. The folder as recited in claim 11 wherein the receiving elements are driven on the shafts.

15. The folder as recited in claim 11 wherein the receiving elements are supported on cylindrical or slide-type receiving members.

16. The folder as recited in claim 15 wherein, to laterally adjust acting drives, the cylindrical or slide-type receiving elements are provided as threaded spindles having contrary-sense threaded sections.

17. The folder as recited in claim 16 wherein the threaded spindle extends through the receiving elements.

18. The folder as recited in claim 16 wherein the receiving elements guiding the individual belts are capable of being directly driven on the contrary-sense threaded sections of the adjusting shaft.

19. The folder as recited in claim 18 wherein the receiving elements used for guiding the individual belts are supported so as to be locked against rotation.

20. The folder as recited in claim 11 wherein outer individual belts of the plurality of belts are movable, individually or in pairs, in the lateral direction.

* * * * *